US007588170B2

(12) United States Patent
van der Heijden

(10) Patent No.: US 7,588,170 B2
(45) Date of Patent: Sep. 15, 2009

(54) DISPENSING UNIT

(75) Inventor: Edgar Ivo Maria van der Heijden, Broek op Langedijk (NL)

(73) Assignee: Airspray International B.V., Alkmaar (NL)

( * ) Notice: Subject to any disclaimer, the term of this patent is extended or adjusted under 35 U.S.C. 154(b) by 487 days.

(21) Appl. No.: 10/518,661

(22) PCT Filed: Jun. 18, 2003

(86) PCT No.: PCT/NL03/00489

§ 371 (c)(1),
(2), (4) Date: Jul. 5, 2005

(87) PCT Pub. No.: WO03/106045

PCT Pub. Date: Dec. 24, 2003

(65) Prior Publication Data

US 2005/0242118 A1 Nov. 3, 2005

(30) Foreign Application Priority Data

Jun. 18, 2002 (NL) ..... 1020889
Jun. 18, 2002 (NL) ..... 1020890

(51) Int. Cl.
*B67D 5/52* (2006.01)

(52) U.S. Cl. ..... 222/137; 222/135; 222/255; 141/2; 141/18

(58) Field of Classification Search ..... 222/135, 222/255, 252, 251, 137, 256, 386, 387, 389, 222/390, 391, 257; 141/2, 4, 5, 7, 9, 18, 141/65, 100; 417/523, 524
See application file for complete search history.

(56) References Cited

U.S. PATENT DOCUMENTS 3,194,447 A 7/1965 Brown (Continued)

FOREIGN PATENT DOCUMENTS

EP 0499538 A1 8/1992

(Continued)

OTHER PUBLICATIONS

PCT International Search Report for International application No. PCT/NL03/00489 (4 pages) and English translation (5 pages).

(Continued)

*Primary Examiner*—Frederick C. Nicolas
(74) *Attorney, Agent, or Firm*—Hoffmann & Baron, LLP; John S. Sopko

(57) ABSTRACT

The invention relates to a dispensing unit for dispensing two fluid substances. The dispensing unit comprises a pump assembly (2) having a first (4) and a second pump (5) which can be actuated by common, manually operable operating means (6) in order to simultaneously dispense the two fluid substances. The dispensing unit also comprises a reservoir assembly (3), the reservoir assembly comprising two reservoirs which are each provided at an outlet side with an outlet and are each delimited by a movable piston (13, 16) on the other side from the outlet, which pistons, during the dispensing of the fluid substances, move toward the respective outlets. According to a first aspect of the invention, the reservoir assembly (3) and the pump assembly (2) are separate assemblies which can be coupled to one another, in such a manner that in the uncoupled state each reservoir can be filled through the outlet of the reservoir, after which the pump assembly and the reservoir assembly are coupled to one another.

17 Claims, 6 Drawing Sheets

U.S. PATENT DOCUMENTS

| | | | | | |
|---|---|---|---|---|---|
| 4,212,332 | A | | 7/1980 | Kutik et al. | |
| 4,438,871 | A | * | 3/1984 | Eckert | 222/137 |
| 4,773,562 | A | * | 9/1988 | Gueret | 222/135 |
| 4,875,604 | A | | 10/1989 | Czech | |
| 4,949,874 | A | * | 8/1990 | Fiedler et al. | 222/135 |
| 5,224,627 | A | * | 7/1993 | Weag | 222/135 |
| 5,237,797 | A | | 8/1993 | Varlet | |
| 5,351,862 | A | | 10/1994 | Weag | |
| 5,823,394 | A | * | 10/1998 | Davis et al. | 222/137 |
| 5,918,771 | A | | 7/1999 | van der Heijden | |
| 6,341,717 | B2 | * | 1/2002 | Auer | 222/135 |

FOREIGN PATENT DOCUMENTS

| | | |
|---|---|---|
| NL | 1004332 | 12/1997 |
| WO | 93/04940 | 3/1993 |
| WO | 99/25627 | 5/1999 |

OTHER PUBLICATIONS

PCT International Preliminary Examination Report for International application No. PCT/NL03/00489 (15 pages).

PCT Written Opinion for International application No. PCT/NL03/00489 (7 pages).

* cited by examiner

DISPENSING UNIT

CROSS-REFERENCE TO RELATED APPLICATIONS

This application is the National Stage of International Application No. PCT/NL03/00489, filed Jun. 18, 2003, which claims the benefit of Netherlands Application No. NL 1020889, filed Jun. 18, 2002 and Netherlands Application No. NL 1020890, filed Jun. 18, 2002, the contents of each of which are incorporated by reference herein.

FIELD OF THE INVENTION (I)

A first aspect of the present invention relates to a dispensing unit for dispensing two fluid substances in accordance with the preamble of originally filed claim 1. The first aspect of the invention also relates to the reservoir assembly of a dispensing unit of this type.

BACKGROUND OF THE INVENTION (I)

WO 93/04940 has disclosed a dispensing device for simultaneously dispensing two fluid substances.

This dispensing device has a first reservoir, which is delimited by an inner side of a first cylindrical tube, and a second reservoir, which is delimited by the outer side of the first cylindrical tube and an inner side of a second cylindrical tube. The first and second tubes are arranged concentrically with respect to one another, the second tube surrounding the first cylindrical tube. On the side remote from the outlet side, the first reservoir is delimited by a continuous disk-like piston and the second reservoir by an annular piston.

In the known dispensing unit, the two reservoirs are filled from the underside, where the piston is located. Filling from the top is not possible, since both the inlet valve and the outlet valve of the first and second pumps do not allow the fluid substance to flow in the opposite direction. Therefore, the reservoir is filled at its still open underside, after which the corresponding piston is moved into the reservoir which has been filled before. One drawback of positioning the piston afterwards is that air is present between the fluid substance and the piston in the reservoir.

This air which is present in a reservoir means that the volume which is subsequently dispensed by the pump in one pump stroke is not always constant. This is undesirable in particular in the case of dispensing units which dispense two fluid substances in a defined volumetric ratio, since a slight difference in volume in the fluid substance dispensed can cause a considerable deviation in the intended volumetric ratio between the two fluid substances dispensed. The latter problem occurs in particular if the difference in volume between the first fluid substance dispensed during a pump stroke and the second fluid substance is considerable.

There are also known reservoir assemblies in which—after the filling via the open underside—a piston provided with a closable opening is put in place. Air can escape via this opening, after which the opening is closed off. Closing off the opening in the piston then requires additional operations to be carried out during the filling of the reservoir assembly.

In general, therefore, it is not easy to fill the known reservoirs of the abovementioned type and it is difficult to prevent air from being present between the piston and the fluid substance.

SUMMARY OF THE INVENTION (I)

The object of the first aspect of the invention is to create an improved dispensing unit for dispensing two fluid substances.

The object is achieved with a dispensing unit in accordance with the preamble of originally filed claim 1 which is characterized in that the reservoir assembly and the pump assembly are separate assemblies which can be coupled to one another, in such a manner that in the uncoupled state each reservoir can be filled through the outlet of the reservoir, after which the pump assembly and the reservoir assembly are coupled to one another.

As a result of the reservoirs of the reservoir assembly being filled through the outlets, there is no need to form an opening in the reservoirs which has to be closed up again after the filling operation, i.e. there is no need either to put the piston in place after the filling operation or to close up an opening in the piston. This makes it easier to fill a reservoir assembly according to the first aspect of the invention with the first and second fluid substances in the first and second reservoirs, respectively.

Another advantage is that with the reservoir assembly according to the first aspect of the invention, it is possible to prevent air from being trapped between the pistons and the fluid substances introduced into the reservoirs.

For the reservoir to be filled, it is preferable for each piston to be located in a piston filling position in the vicinity of the outlet. This has the advantage that there will be little or scarcely any air in the reservoir prior to the filling operation. This means that there is even less risk of air remaining inside the filled reservoir. This does require the piston to be able to move in opposite directions, i.e. towards the outlet and away from the outlet. During the filling operation, the piston then moves from the filling position in the vicinity of the outlet toward the piston position associated with a completely filled reservoir. The risk of air being present in the filled reservoir can be reduced even further by at least partially sucking the air out of the reservoirs using a vacuum pump or the like prior to the filling operation. This is possible in particular if, during the filling operation, a filling unit which has a filling head which can be placed on the reservoir assembly and which is connected to a vacuum pump of this type is used.

The diameter or cross section of the first and/or second reservoir advantageously decreases in the direction of the outlet side over at least a section of the length of the reservoir.

It is preferable for the pistons for a dispensing unit in accordance with the first aspect of the invention to be made from a plastic which is sufficiently resilient to enable the piston to bear in a sealed manner against the walls of the reservoir in question. One drawback of a plastic material of this nature is that it experiences relaxation over the course of time. This will reduce the resilience, with the result that the seal against the walls will also deteriorate. As a result of the width of the first and/or second reservoir being made to decrease in the direction of the outlet side, the piston will, as it were, be pulled increasingly more firmly into the cylindrical tube. This compensates for any reduced sealing action of the piston caused by the drop in resilience of the material of which it is made, with the result that a leak-free piston can be ensured during use of the dispensing unit.

However, one consequence of a decreasing reservoir width in the direction of the outlet side would be that the further the piston moves towards the outlet, the greater the prestress which is applied to the piston. In particular in the abovementioned piston position in the vicinity of the outlet, the prestress will then be relatively high. This has the drawback that this prestress will cause the relaxation in the plastic material of the piston to occur more quickly. This is particularly disadvantageous when the piston is located in the vicinity of the outlet prior to the filling operation, since reservoir assemblies of this type are generally stored for a certain time after production before being filled.

Relaxation can however also occur if the diameter or cross section of the reservoir in question is designed to be constant over the length of the reservoir, since the piston which is already present in the reservoir is generally under a certain prestress therein.

Consequently, it is preferable for the diameter or cross section of the reservoir to be increased over part of the length of the reservoir at the abovementioned filling position in the vicinity of the outlet, in such a manner that the piston is under reduced prestress in the abovementioned filling position in the vicinity of the outlet. Designing the diameter or cross section of the reservoir in this way prevents the abovementioned rapid relaxation of the plastic piston material in the piston located in the vicinity of the outlet. Consequently, as yet unfilled reservoir assemblies can be stored for a prolonged period of time with the pistons in the filling positions in the vicinity of the outlet.

However, one drawback of this is that while the dispensing unit is being used, involving the reservoir in question being emptied, the piston can start to leak when it reaches the vicinity of the outlet. However, since the reservoir is then virtually empty, the latter drawback does not present a major problem in practice.

It should be noted that if the pistons, prior to the filling of the reservoir in question, are in a different filling position, in particular in the position furthest away from the outlet, it is advantageous for the diameter or cross section of the reservoir to increase at the piston position in which the piston is located prior to the filling of the reservoir in question, so that the piston is under a reduced prestress in this filling position.

The first aspect of the invention also relates to a reservoir assembly which is clearly intended for a dispensing unit in accordance with the first aspect of the invention and to a method for filling an assembly of this type. The first aspect of the invention also relates to a filling head for filling a reservoir assembly in accordance with the first aspect of the invention.

FIELD OF THE INVENTION (II)

A second aspect of the invention relates to a dispensing unit for dispensing a first and a second fluid substance in a defined (volumetric) ratio, comprising:

- a first and a second reservoir for a stock of the first and second fluid substances, respectively,
- a pump assembly which comprises a first and a second pump, which each have a pump chamber with a defined operative volume, and a common, manually operable operating member for actuating the first and second pumps.

BACKGROUND OF THE INVENTION (II)

WO 93/04940 has disclosed a dispensing unit for dispensing a first and a second fluid substance, which dispensing unit comprises a pump assembly having a first pump and a second pump for pumping the first and second fluid substances and a manually operable operating member which can be used to actuate the pump assembly. The pumps are arranged concentrically with respect to one another.

The first and second pumps of the known dispensing unit each comprise a piston and a cylinder which together delimit a pump chamber. Each pump chamber has an inlet for sucking fluid substance out of the respective reservoir and an outlet for dispensing a fluid substance through an outlet passage to a dispensing opening.

A pump assembly of this type is designed to dispense a defined quantity of the two fluid substances in a predetermined volumetric ratio each time the operating member is operated. For the known unit, this volumetric ratio may be between 1:1 and 1:9. In this case, it is necessary to create a specific dispensing unit of suitable dimensions for each individual volumetric ratio. It may be desirable to match the dispensing unit to a desired volumetric ratio, in particular in the case of fluid substances which can be used in a plurality of ratios to give different effects. In the case of the known dispensing unit, for each volumetric ratio this requires all the separate components of the pump assembly to have specific dimensions which differ from a pump assembly for another volumetric ratio. This leads to logistical drawbacks relating to the storage and production of these separate components which differ for dispensing units for different volumetric ratios.

SUMMARY OF THE INVENTION (II)

The object of the second aspect of the invention is to provide a dispensing unit in accordance with the present invention, with which it is possible to easily match the dispensing device to a desired pump delivery of and/or volumetric ratio between the two fluid substances which are to be dispensed by the dispensing unit when a pump is actuated.

The object of the second aspect of the invention is to provide a dispensing unit in accordance with the present invention, with which it is possible to easily match the dispensing device to a desired pump delivery of and/or volumetric ratio between the two fluid substances which are to be dispensed by the dispensing unit when a pump is actuated.

The object is achieved by a dispensing unit in accordance with the present invention which is characterized in that the pump assembly comprises one or more exchangeable pump elements which form at least a section of the first and/or second pump. By selection of one or more suitable exchangeable pump elements and by fitting them in the pump assembly, it is possible to adapt the operative volume of the pump chamber of the first and/or second pump.

The object is achieved by a dispensing unit in accordance with the present invention which is characterized in that the pump assembly comprises one or more exchangeable pump elements which form at least a section of the first and/or second pump. By selection of one or more suitable exchangeable pump elements and by fitting them in the pump assembly, it is possible to adapt the operative volume of the pump chamber of the first and/or second pump.

The creation of a pump assembly with one or more separate exchangeable pump elements makes it easy to change the operative volume of the pump chamber, i.e. the quantity of fluid substance dispensed by the pump in the event of the latter being operated, for one or both pumps by suitable selection of the one or more exchangeable pump elements. By adapting one or both volumes which are dispensed by the pumps each time the pump is operated, it is also possible to adapt the volumetric ratio between the fluid substances dispensed in one pump stroke as required. It is then no longer necessary for all the components of the pump assembly to be specifically dimensioned for each volumetric ratio and delivery.

Consequently, there is no need to keep a separate stock of components for each desired volumetric ratio between the fluid substances which are to be dispensed, with the exception of the exchangeable pump elements.

In this context, it should be noted that in general the dispensing units are put together in such a manner that, after assembly by the producer, they will be difficult or impossible to dismantle. Moreover, they are generally disposed of after use. In this context, the word "exchangeable" should be read as indicating a choice which will be made during assembly. Subsequent replacement of the exchangeable pump elements will generally only be possible in specific designs. Therefore, the second aspect of the invention provides benefits in particular with regard to production and logistics, since less specifically dimensioned components will be required for dispensing devices with different volumetric ratios.

Although the retrospective exchange of the exchangeable pump elements will generally take place less frequently, this possibility is not ruled out by the second aspect of the invention.

The pump assembly advantageously comprises a base part with a holding section for holding at least one of the exchangeable pump elements, the holding section preferably being designed to centre and/or position the exchangeable pump element which is held therein. With a base part of this type, it is easy to place the respective exchangeable pump element into the pump assembly in the correct way.

In one embodiment, the pump assembly comprises a first exchangeable pump element which is both held in the base part and coupled to the operating member. Since the operating member and the base part move with respect to one another when the pumps are operated, in this embodiment it is necessary to provide a flexible exchangeable pump element or an exchangeable pump element which comprises at least two components which can move with respect to one another.

In one embodiment, the first and/or second pump is a bellows pump, the first exchangeable pump element at least in part forming a bellows pump chamber. With an embodiment of this type, it is easy to match the volume dispensed by the pump in question in one pump stroke.

In another embodiment, the pump assembly comprises a first and a second exchangeable pump element, the first exchangeable pump element being coupled to the operating member and the second exchangeable pump element being held in the base part. In this embodiment, two components which can move with respect to one another when the pumps are operated are created exchangeably. This has the advantage that the exchangeable pump element does not have to be coupled both to the operating member and to the base part. This is because having to do so can constitute an assembly drawback, certainly in view of the flexibility/movability which is then required of the exchangeable pump element.

In a further embodiment, the first and/or second pump is a piston pump, the first exchangeable pump element forming the piston of the first or second pump, respectively, and the second exchangeable pump element forming the cylinder of the first or second pump, respectively. By using a piston pump, it is possible to accurately dispense a defined volume. This is advantageous in particular if the volumetric ratio between the volumes dispensed by the-two pumps is high. A slight deviation in the volume of a fluid substance dispensed when a pump is operated can then lead to a considerable deviation from the desired volumetric ratio.

In a preferred embodiment, each pump is a piston pump, and the first exchangeable pump element forms both pistons and the second exchangeable pump element forms both cylinders. In this embodiment, in each case only two components are required to adapt the operative volumes of the pump chambers of the two pumps. With a dispensing device of this type, it is possible to produce a considerable range of volumetric ratios, for example from 1:1 to 1:25.

The pump assembly is advantageously releasably coupled to the first and/or second reservoir preferably via the base part of the pump assembly. It is then possible, for example, to replace an empty reservoir with a new, full reservoir. If the pump assembly is formed integrally with one or both reservoirs, it is possible for the base part to be integrated with the top side of one or both reservoirs.

It is preferable for the first and second reservoirs to be of the "airless" type, i.e. for the fluid substance dispensed not to be replaced in the reservoir by air, but rather for the volume of the reservoir to be reduced as the volume of the fluid substance dispensed increases. This is possible, for example, by designing the reservoir as a flexible pouch which becomes smaller as the fluid substance is dispensed. The "airless" reservoir is preferably a cylindrical wall in which there is a piston which, during the dispensing of the fluid substance, is drawn towards the outlet of the reservoir, so that the volume of the reservoir is thereby reduced.

With airless-type reservoirs of this type, it is possible to dispense a very accurate quantity by means of a pump of the pump assembly, since this quantity is not affected or is scarcely affected by the air pressure prevailing in the reservoir.

The one or more exchangeable pump elements according to the second aspect of the invention can also be used in a dispensing device in which only one fluid substance is pumped. The exchangeable pump elements are then used only to adapt the operative volume of the pump chamber of the pump in order to adjust the quantity of fluid substance dispensed by the dispensing unit in the event of a pump being operated as desired. The various embodiments of the exchangeable pump element and the associated pumps which have been discussed above in connection with two pumps can then be applied in a corresponding way to the single pump of the dispensing unit for pumping one fluid substance.

A dispensing unit of this type is useful for dispensing one fluid substance. The second aspect of the invention also relates to a pump assembly which is clearly intended for a dispensing unit in accordance with the present invention.

A dispensing unit of this type is useful for dispensing one fluid substance. The second aspect of the invention also relates to a pump assembly which is clearly intended for a dispensing unit in accordance with the present invention.

It will be clear to the person skilled in the art that it is possible to combine one or more of the measures of the first and second aspects of the invention in a dispensing unit. Such a combination of one or more measures of the first aspect of the invention with one or more measures of the second aspect of the invention is deemed to be covered by the scope of protection.

Further advantages and characteristics of the first and second aspects of the invention will be explained below with reference to a preferred embodiment shown in the drawing, in which:

DETAILED DESCRIPTION OF THE INVENTION

Figures 1, 1A:
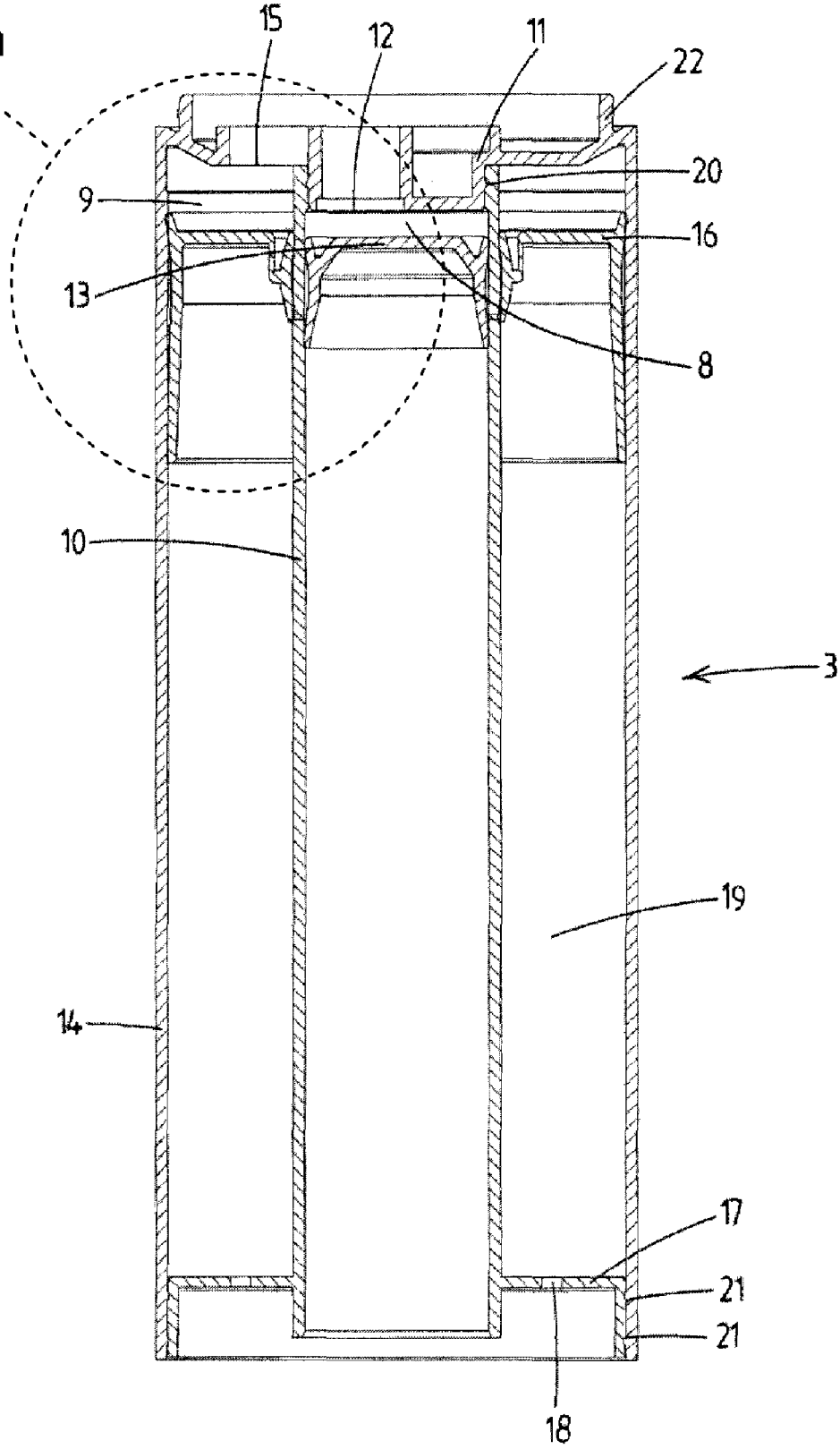
FIG. 1*a* is an enlarged view of the circled portion 1*a* of FIG. 1 showing the first and second reservoirs and corresponding pistons therein in the vicinity of the respective outlets of the reservoirs.
Figure 1A:
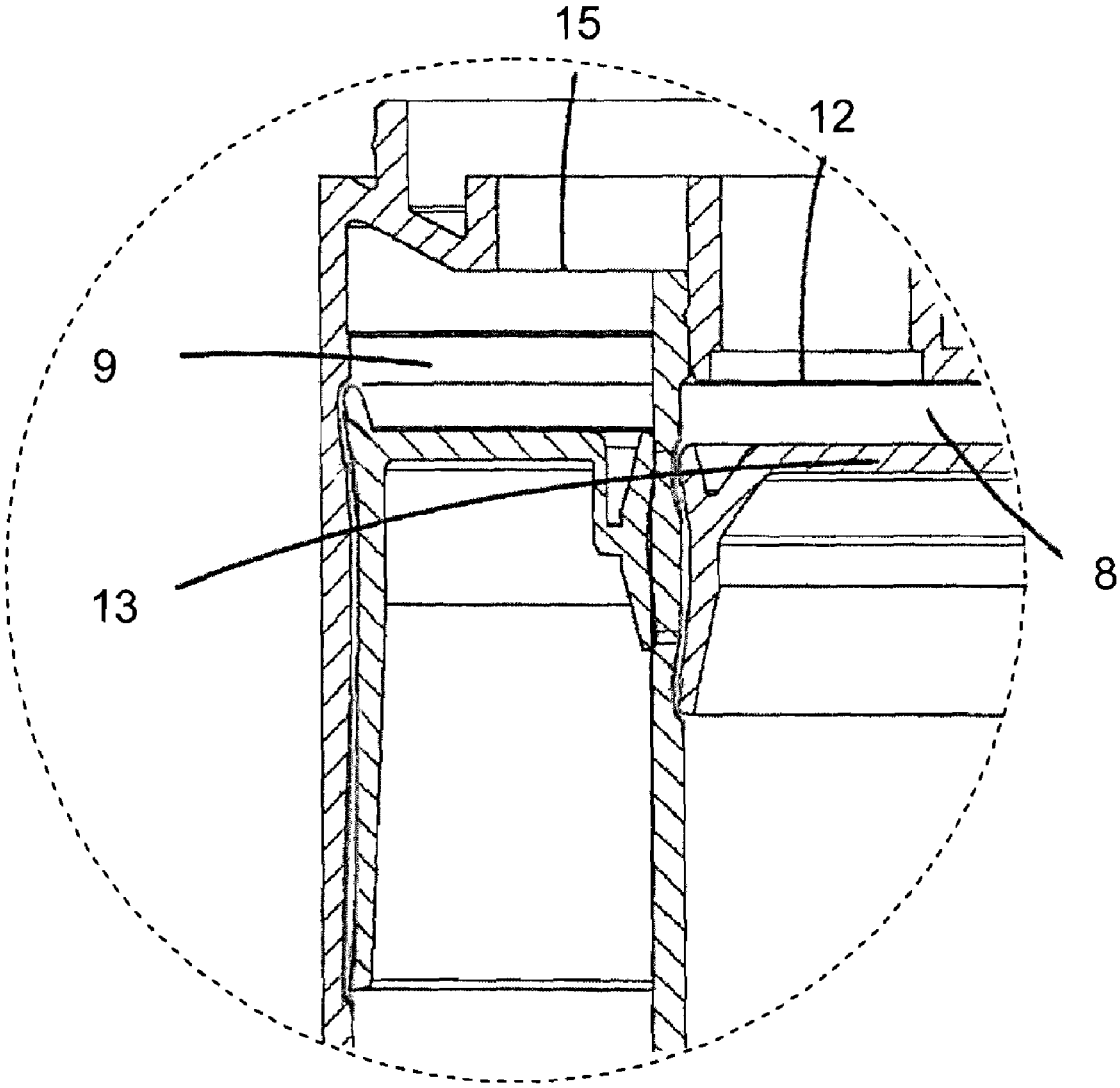
Figure 2:
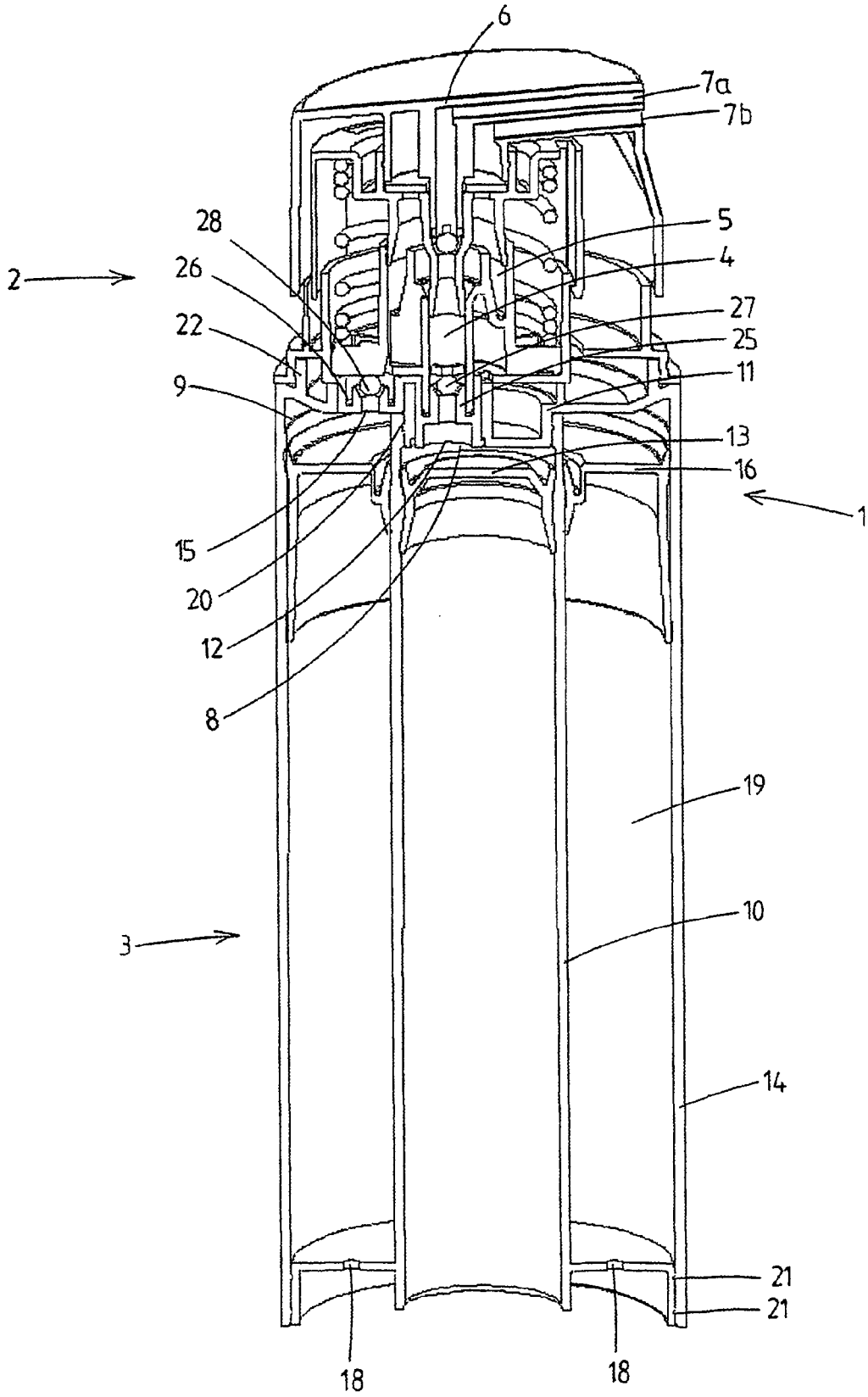
FIG. 2 shows a perspective view of a cross section through a dispensing unit in accordance with the first aspect of the invention, in which reservoir assembly and pump assembly are coupled to one another.

FIG. 2 shows a dispensing unit for simultaneously dispensing two fluid substances, denoted overall by reference numeral 1. The dispensing unit 1 is suitable for holding in the hand and comprises a pump assembly 2 and a reservoir assembly 3. The pump assembly 2 and the reservoir assembly 3 are assemblies which are separate but can be coupled to one another and in this figure are shown coupled to one another. The reservoir assembly 3 is shown separately in FIG. 1.

The pump assembly 2 of the dispensing unit 1 comprises a first pump 4 and a second pump 5, and also an operating member which is designed as an operating button 6. By operation of the operating button 6, the first and second pumps 4, 5 are actuated, with the fluid substances being dispensed simultaneously through dispensing openings 7*a*, 7*b*. The pumps 4, 5 shown are piston pumps. It is also possible to provide pumps of a different type, for example bellows pumps, instead of piston pumps.

If appropriate, the pump 4 and/or the pump 5 may be a foam-forming (piston) pump with a pump section for the fluid substance and a pump section for sucking in air, which air is mixed with the fluid substance, so that the latter is dispensed as a foam.

The reservoir assembly 3 comprises a first reservoir 8 and a second reservoir 9. The two reservoirs 8, 9 are of the so-called "airless" type, in which the space which is formed by the dispensing of the fluid substances in the reservoir is absorbed by a decrease in size of the reservoir in question, in the present case by means of a piston which can move inside the reservoir.

The first reservoir 8 is delimited by an inner side of a first cylindrical tube 10. The first cylindrical tube 10 is closed off on an outlet side which is common to the first and second reservoirs 8, 9 by a cover 11 in which there is a first outlet 12. That end of the first reservoir 8 which is remote from the outlet 12 is delimited by a movable, continuous, substantially disk-like piston 13.

The second reservoir 9 is delimited by the outer side of the first cylindrical tube 10 and an inner side of a second cylindrical tube 14. The first and second cylindrical tubes 10, 14 are arranged concentrically with respect to one another, the second cylindrical tube 14 surrounding the first cylindrical tube 10.

The second cylindrical tube 14 is also closed off by the cover 11 at the common outlet side. An outlet 15 is provided in the annular section of the cover 11 which closes off the second reservoir 9, i.e. between the first and second cylindrical tubes 10 and 14, respectively. On that side of the second reservoir 9 which is remote from the outlet 15, the second reservoir is delimited by a movable, continuous, substantially annular piston 16.

FIG. 1 shows the two pistons 13, 16 in a first filling position in the vicinity of the outlets, in which the two reservoirs 8, 9 of the reservoir assembly 3 have not yet been filled. The cover 11 of the reservoir assembly 3 is suitable for receiving a filling head of a filling unit, which filling head is designed to fill the reservoirs 8, 9 through the outlets 12, 15. During the filling, the pistons 13, 16 will move away from the outlet side towards a second piston position, in which, during use of the dispensing unit, the pistons are located furthest from the outlet side.

After the filling operation, the pump assembly 2 is coupled to the reservoir assembly 3. The cover 11 is provided with a coupling rim 22 for this purpose. Furthermore, the pump assembly 2 has connection pieces 25, 26 on the underside, for the pumps 4, 5 which respectively fit into the outlets 12, 15. In this case, the suction valves 27, 28 of the pumps 4, 5 are accommodated in the connection pieces 25, 26. It is preferable for one or both of the connection pieces 25, 26 to form a click-fit connection to the cover 11.

As a result of the subsequent operation of the two pumps 4, 5 with the aid of the operating button 6, the two fluid substances will be dispensed simultaneously with a predetermined volumetric delivery and in a defined volumetric ratio. As a result of the fluid substances having been dispensed from the reservoir by the dispensing unit 1, the two pistons 13, 16 will move back towards the outlet side.

The two pistons 13, 16 are made from a suitable plastic. A plastic of this type will generally undergo relaxation, with the result that the sealing lips of the pistons 13, 16 will become ever less resilient over the course of time, so that the seal formed as they bear against the inner side of the first tube 10 and the outer side of the first tube 10 and the inner side of the second tube 14 will deteriorate. Consequently, the pistons may start to leak.

To counteract this effect, in the preferred embodiment shown, the diameter or cross section of the first and/or second reservoir decreases towards the outlet side at least between the piston position associated with a completely filled reservoir and the filling position of the piston. For this purpose, for the first reservoir 8 the diameter of the inner side of the first cylindrical tube 10 decreases in the direction of the outlet side. For the second reservoir 9, the diameter of the inner side of the second cylindrical tube 14 decreases in the direction of the outlet side while the outer side of the first cylindrical tube 10 is designed to be straight. In a variant, this outer side of the first cylindrical tube 10 may have a diameter which increases in size in the direction of the outlet side.

As has been described above, the pistons 13, 16 are located in a filling position in the vicinity of the outlets 12, 15 prior to the filing of the reservoir assembly 3. The pistons 13, 16 of the reservoir assembly 3 of a dispensing unit will already be in this filling position after assembly of the reservoir assembly 3. Often, a reservoir assembly 3 of this type will be stored for a certain time before being filled with the fluid substances. To prevent relatively high levels of relaxation occurring in the material of the pistons 13, 16 during this storage of the reservoir assembly 3 as a result of the prestress with which the pistons 13, 16 are arranged in the reservoirs 8, 9 the diameter of cross section of the first and/or second reservoir 8, 9 is increased at the abovementioned filling position in the vicinity of the outlet, as shown in FIG. 1*a*. Consequently, the pistons 13, 16 are under a reduced prestress (or even stressfree) in the abovementioned filling position in the vicinity of the outlet, and the abovementioned relaxation will not occur or will scarcely occur.

Therefore, for the preferred embodiment shown, for the first reservoir 8 the diameter of the inner side of the first cylindrical tube 10 at the abovementioned filling position substantially corresponds to the diameter of the disk-like piston 13, as shown in FIG. 1*a*. For the second reservoir 9, the distance between the outer side of the first cylindrical tube 10 and the inner side of the second cylindrical tube 14 at the abovementioned filling position in the vicinity of the outlet substantially corresponds to the width of the ring of the annular piston 16, shown in FIG. 1*a*. Modifying the reservoirs 8, 9 in this way ensures that the pistons 13, 16 have sufficient resilience to remain leak-free during use even if the reservoir assembly 3 in question is store for a prolonged period of time (in the filled or unfilled state).

It can be seen from the figures that the reservoir assembly comprises a connecting element 17 which, in the vicinity of the ends of the first tube 10 and the second tube 14 which are remote from the outlet side, connects these tubes 10, 14 to one another. The connecting element 17 is formed integrally with the first cylindrical tube 10. Also, the cover 11 and the second cylindrical tube 14 are formed integrally. A number of openings 18 are formed in the connecting element 17, so that the space 19 between the annular piston 16 and the connecting element 17 is in communication with the outside air.

The reservoir assembly 3 is therefore formed from two pistons 13, 16 and two reservoir elements, namely a first reservoir element which comprises the first cylindrical tube 10 and the connecting element 17 and a second reservoir element which comprises the second cylindrical tube 14 and the cover 11. The two reservoir elements are coupled to one another by a first snap-action or click-fit connection 20 between the cover and the first cylindrical tube 10 and a second snap-action or click-fit connection 21 between the connecting element 17 and the second cylindrical tube 14. This results in a very simple structure of the reservoir assembly 3 with the two reservoirs 8 and 9 which also comprises all the preferred characteristics described above. This structure comprising two reservoir elements makes an accurate concentric arrangement of the tubes 10 and 14 possible in a form which is advantageous in terms of production engineering.

According to a preferred embodiment, the filling unit for filling the two reservoirs 8, 9 comprises a filling head which is designed to be placed onto the cover 11 of the reservoir assembly 3 and to fill the two reservoirs simultaneously through the outlets 12, 15. To be correctly positioned, the filling head has, for example, a rim which corresponds to the coupling rim 22 and by means of which the filling head is centred on the reservoir assembly 3. The filling head also has two projecting filling sections which are positioned at least partially in the outlets 12, 15 in order to fill the reservoirs 8, 9 and with which the filling head is also correctly positioned with respect to the reservoir assembly 3.

To fill each reservoir, the filling unit comprises a pump, in particular a plunger pump. In this case, the filling unit is preferably also provided with at least a third pump for sucking out the air in each reservoir before the reservoirs are filled with the fluid substances. This also prevents air from remaining in the filled reservoir.

Figure 3:
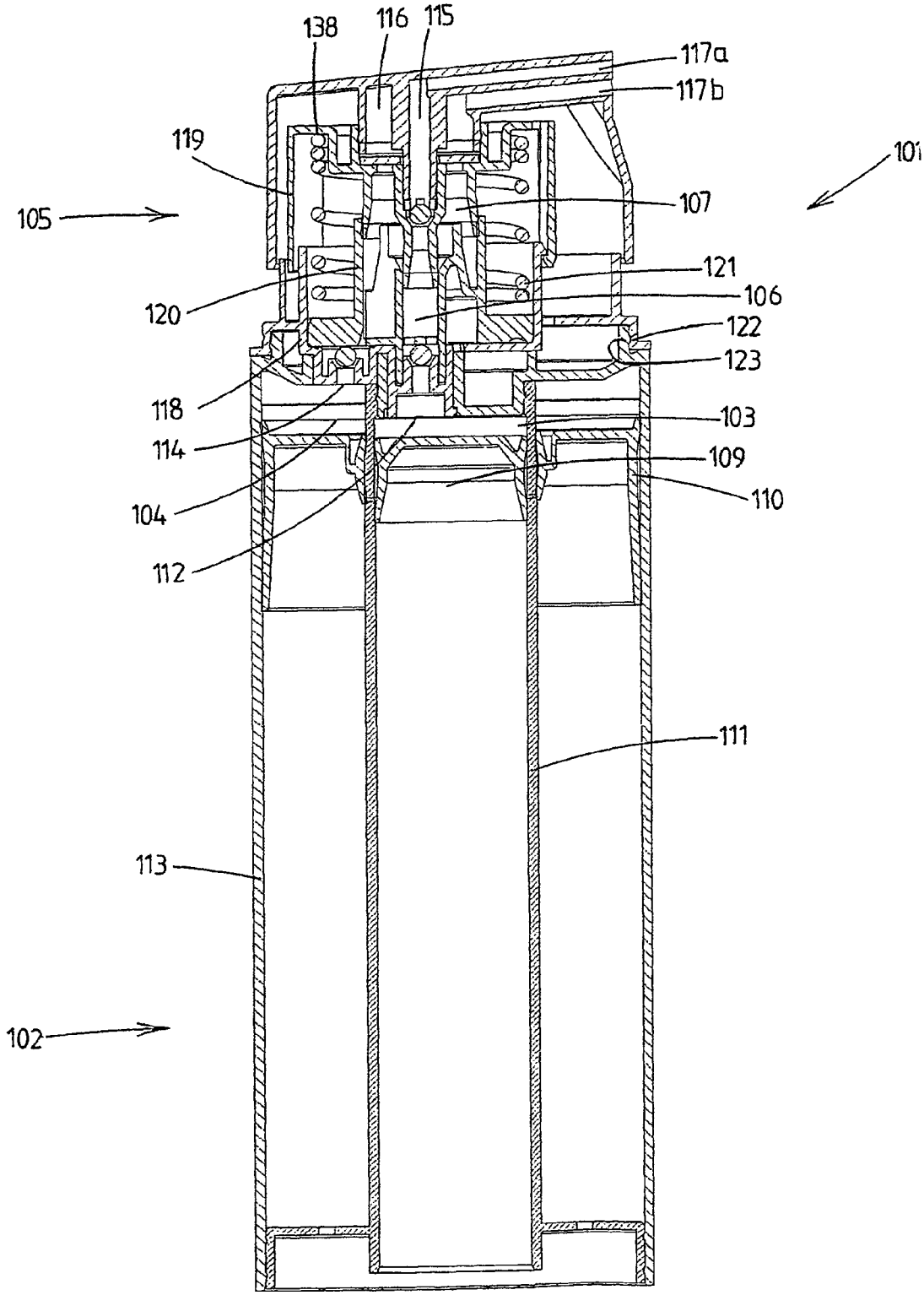
FIG. 3 shows a cross section through a dispensing unit in accordance with the second aspect of the invention.

FIG. 3 shows a preferred embodiment of a dispensing unit, denoted overall by reference numeral 101. A dispensing unit 101 of this type is generally suitable for holding in the hand and for the simultaneous dispensing of a first and a second fluid substance.

The dispensing unit 101 comprises a reservoir section 102 having a first reservoir 103 and a second reservoir 104. Furthermore, the dispensing unit comprises a pump assembly 105 having a first pump 106 and a second pump 107 and a common, manually operable member in the form of an operating button 108. In the preferred embodiment shown, the pump assembly 105 can be uncoupled from the reservoir section 102. The uncoupled pump assembly 105 is shown separately in FIGS. 4 and 5. The uncoupled reservoir section 102 is shown separately in FIG. 6.

The volumes of the first and second fluid substances dispensed by the first pump 106 and/or the second pump 107 per pump operation can be adapted as desired in a simple way, and thus so too can the volumetric ratio between the two substances, as will be explained in more detail below for the preferred embodiment. It is therefore advantageous that the volumetric ratio between the first reservoir 103 and the second reservoir 104 can be adjusted by, for example, uncoupling the two reservoirs 103, 104 and replacing them with a combination of reservoirs 103', 104' whose volumetric ratio corresponds to that in which the fluid substances are dispensed. It should be noted that it is also possible to adapt the quantities of fluid substance with which the two reservoirs 103, 104 are filled to the volumetric ratio in which the fluid substances are dispensed.

The two reservoirs 103, 104 are of the "airless" type, i.e. the fluid substance dispensed is not replaced in the reservoir by air, but rather the volume of the reservoir is reduced by the volume of the fluid substance which has been dispensed. For this purpose, the reservoirs are each closed off on one side by a follower piston 109 and 110, respectively. Of course, it is also possible to use reservoirs of a different type, optionally of the "airless" type. By way of example, it is possible to use a pouch-like reservoir or a reservoir with a fixed volume, in which case the space which was taken up by the fluid substance which has been dispensed is then occupied by outside air.

The first reservoir 103 is formed by the space inside a cylindrical wall 111 which forms the side wall of the reservoir 103. At the top side, the reservoir 103 is closed off with the exception of an opening 112 by which the reservoir 103 is in communication with the first pump 106. At the underside, the reservoir 103 is delimited by the follower piston 109. The reservoir is completely filled with the first fluid substance. During the dispensing of this fluid substance, the follower piston 109 moves towards the opening 112, reducing the volume of the reservoir. The drawing shows the follower piston 109 almost in its topmost position, in which the fluid substance present in the reservoir 103 has been almost completely dispensed.

The second reservoir 104 is formed by the space inside a second cylindrical wall 113 but outside the cylindrical wall 111. The second reservoir 104 is therefore annular and lies concentrically with respect to the first reservoir 103. The second reservoir 104 is also closed off at the top with the exception of an opening 114 for communication between the second reservoir and the second pump 107. At the underside, the second reservoir is delimited by the second follower piston 110. In the drawing, the follower piston 110 is also shown in almost its topmost position.

In the embodiment shown in the drawing, the entire reservoir section is formed by two reservoir elements and the two follower pistons 109, 110. The first reservoir element forms the cylindrical outer wall 113 inside which the two reservoirs 103, 104 lie and also the closed top side of the two reservoirs 103, 104. The two openings 112, 114 are provided in this top side in order to allow communication between the reservoirs and the pumps.

The other reservoir element forms the cylindrical wall 111 which on its inner side delimits the first reservoir 103 and on its outer side delimits the second reservoir 104, and closes off the underside of the annular space between the cylindrical inner wall 111 and the cylindrical outer wall 113 of the reservoir section.

Figure 4:
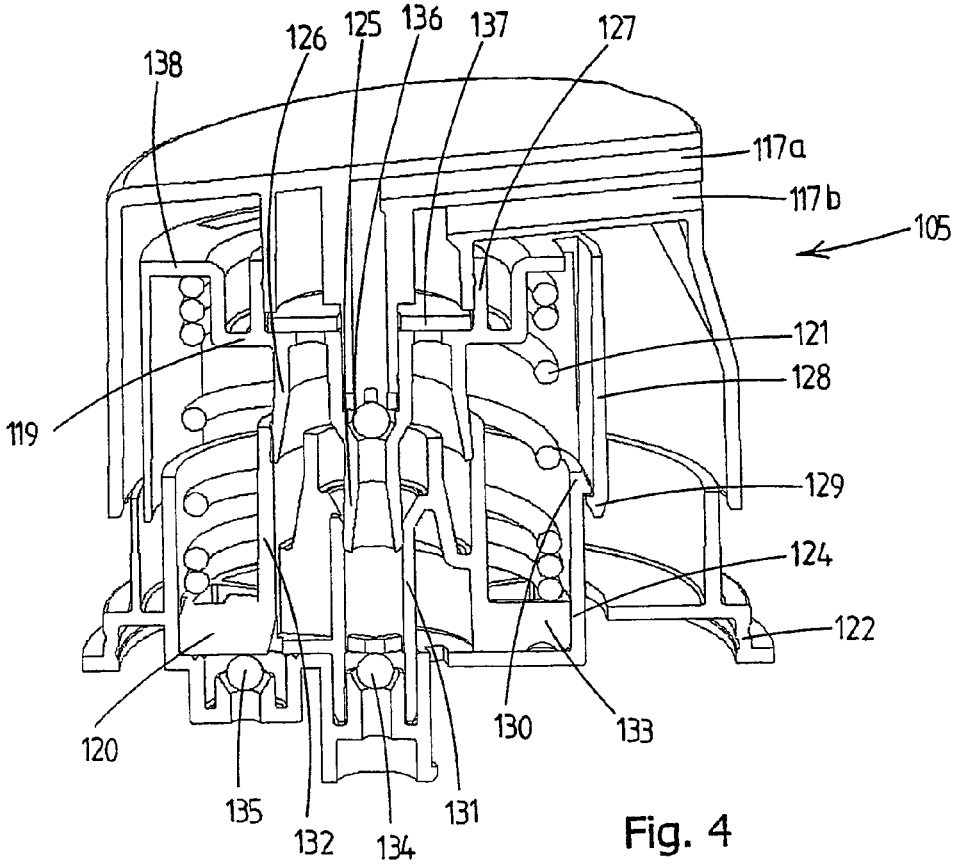
FIG. 4 shows a perspective view of a cross section through the pump assembly of the dispensing unit shown in FIG. 3.

The pump assembly 105 comprises a first pump 106 and a second pump 107 for pumping the first and second fluid substances out of the first and second reservoirs 103, 104, respectively. The first pump 106 and the second pump 107 each have an inlet valve 134 and 135 and each also has an outlet valve 136 and 137 (FIG. 4). The fluid substances dispensed by the first pump 106 and the second pump 107 pass into a first outflow passage 115 and a second outflow passage 116, in which the first and second fluid substances flow to the first dispensing opening 117*a* and second dispensing opening 117*b*, respectively.

Figure 5:
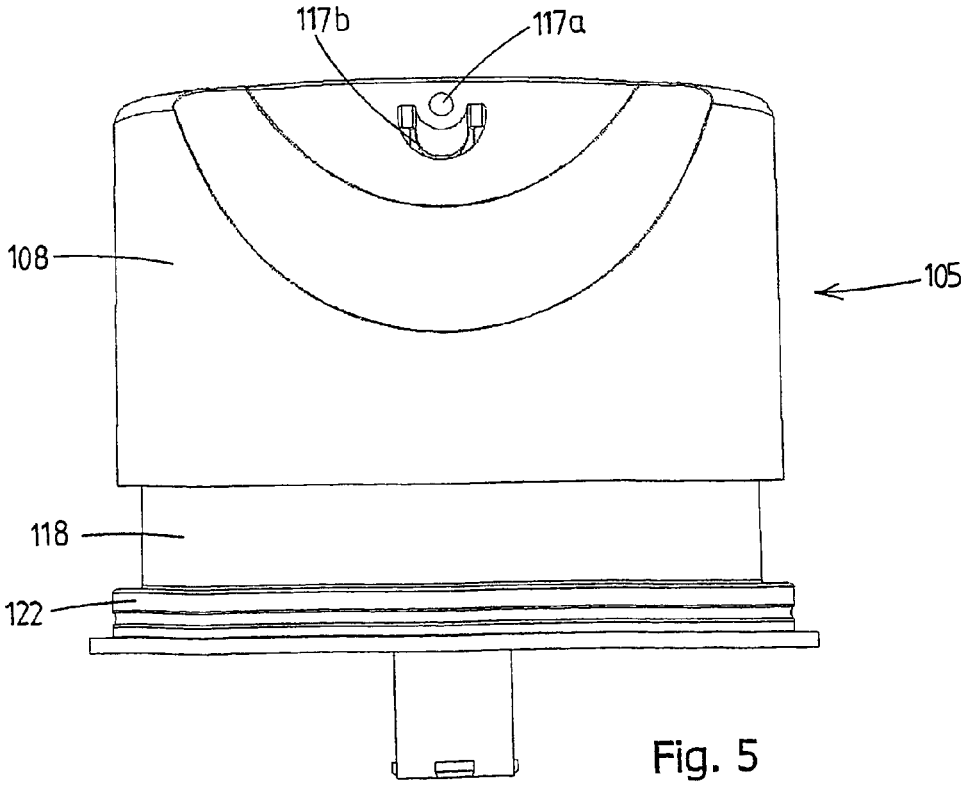
FIG. 5 shows a perspective view of the pump assembly as shown in FIG. 4.
Figure 6:
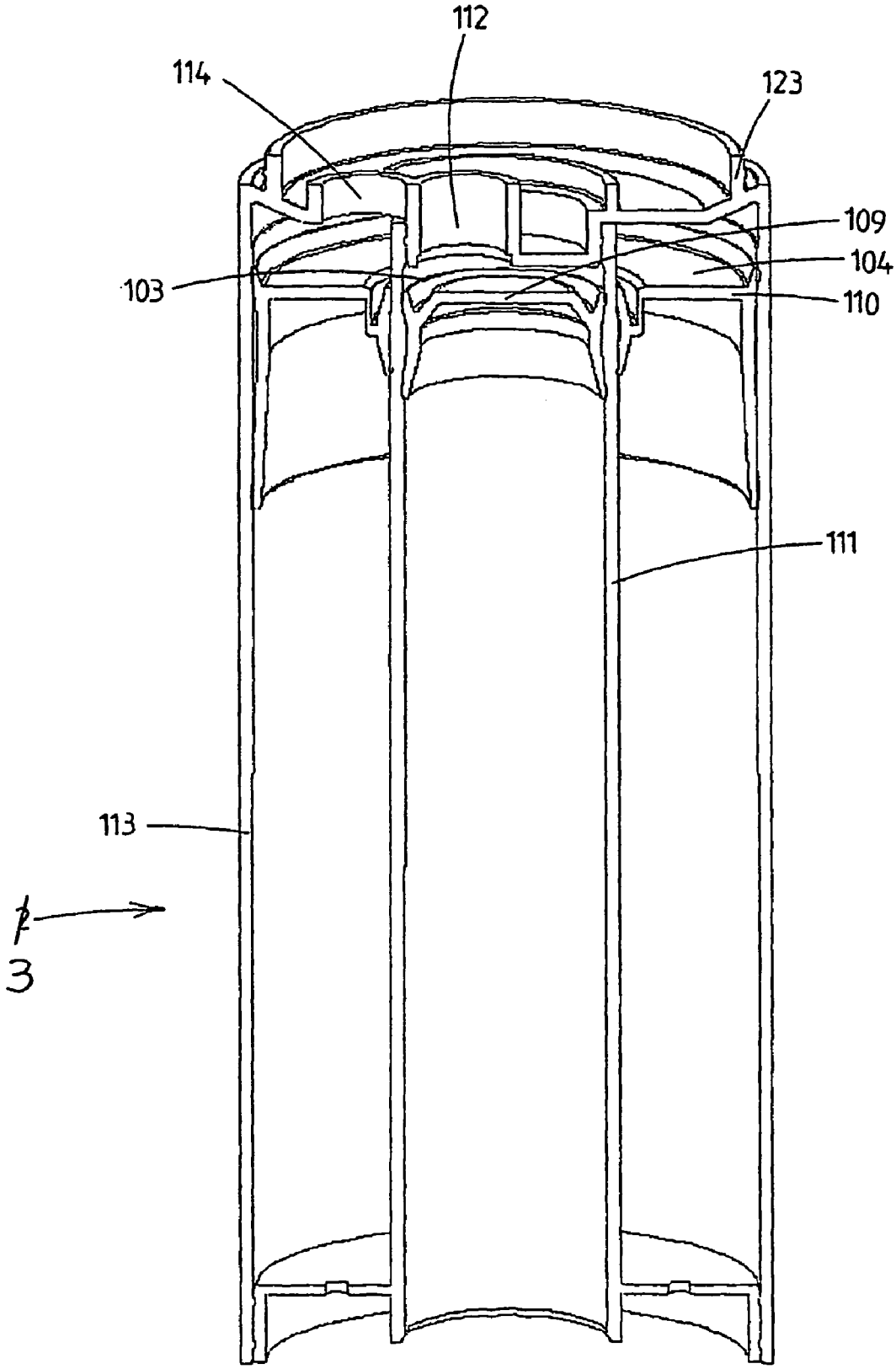
FIG. 6 shows a perspective view of a cross section through the uncoupled reservoir section of the dispensing unit shown in FIG. 3.

The outflow passages 115, 116 shown in the diagram are completely separate, the dispensing openings 117*a*, 117*b* of the two outflow passages being arranged above one another, as can be seen from FIG. 5. It is also possible for the dispensing openings 117*a*, 117*b* of the two outflow passages 115, 116 to be designed concentrically or coaxially. It is also possible for the outflow passages 115, 116 not to be completely separate, but rather to be such that they converge sooner, so that the fluid substances come into contact with one another, before the fluid substances are dispensed. Depending on the design of the outflow passages 115, 116 and the properties of the first and second fluid substances, the fluid substances will then mix with one another to a greater or lesser extent.

The pump assembly 105 is assembled from a base part 118, a first exchangeable pump element 119 which forms the pistons of the first pump 106 and the second pump 107, and a second exchangeable pump element 120 which forms the cylinders of the first pump and the second pump. The pump assembly 105 also comprises a spring 121.

In the preferred embodiment shown, the first pump 106 and the second pump 107 are disposed concentrically with respect to one another. In another embodiment, it is also possible to use a different arrangement of the pumps 106, 107. By way of example, the two pumps 106, 107 may also be disposed next to one another.

The spring 121 is advantageously arranged outside the first and second pumps. As a result, the fluid substances cannot come into contact with the spring 121. Furthermore, there is advantageously an inverted U-section 138 provided in the first exchangeable pump element 119, since this allows a longer spring to be used in the pump assembly without the height of the latter having to be increased. A longer spring has the advantage that the spring exerts a more constant force than a shorter spring of the same type.

The base part 118 has coupling means, in this example a coupling rim 122, which is designed to be coupled to the reservoir section by means of a snap-action connection. For this purpose, the reservoir section is provided with a corresponding coupling rim 123. The coupling rim 122 is also provided with a circumferential groove at the outer circumference. If appropriate, a cover (not shown) can be coupled into this groove. The base part 118 also has a holding section 124 in which the second exchangeable pump element 120 is positioned. The holding section 124 is designed in such a manner that the second exchangeable pump element 120 is centred and if appropriate positioned in this space.

The first exchangeable pump element 119 comprises a first substantially cylindrical wall 125 for forming the piston of the first pump 106 and a second substantially cylindrical wall 126 for forming the piston of the second pump 107. Furthermore, the first exchangeable pump element 119 shown comprises a third substantially cylindrical wall 127 for a snap-action connection for coupling the first exchangeable pump element 119 to the operating button 108. A rib is provided on the cylindrical wall 127 for the purpose of this snap-action connection. Furthermore, the first exchangeable pump element 119 also has a substantially cylindrical wall 128 to which a hook rim 129 is fitted, which is able to couple with a hook rim 130 on the base part 118.

The second exchangeable pump element 120 comprises a first substantially cylindrical wall 131 for forming the cylinder of the first pump 106 and a second substantially cylindrical wall 132 for forming the cylinder of the second pump 107. The second exchangeable pump element 120 also has a third substantially cylindrical wall 133 which bears against the wall of the holding section of the base part 118 for centring and positioning the second exchangeable pump element 120.

The first exchangeable pump element 119 is coupled to the manually operable operating button 108. As a result of the operating button 108 being depressed, the pistons move inside the cylinders of the respective pumps 106, 107. During the depression of the operating button 108, the fluid substance which is present in the pump is at least partially pumped through the outflow passages 115, 116 to the dispensing openings 117*a*, 117*b*. When the operating button 108 is released, the spring 121 presses the pistons upwards with respect to the cylinders. During this movement, fluid substance is drawn out of the reservoirs towards the pump chambers between the pistons and cylinders.

The hook rim 130 on the base part 118 and the corresponding hook rim 129 on the first exchangeable pump element 119 limit the upward movement of the operating button 108 and the first exchangeable pump element 119 caused by the spring 121.

The dispensing unit 101 can easily be adapted to dispense the first and second fluid substances in different volumetric ratios by exchanging the first exchangeable pump element 119 and the second exchangeable pump element 120 for different first and second exchangeable pump elements 119', 120', the surface area of at least one of the pistons of the first pump 106 or second pump 107 being different, so that in the event of a pump stroke a different volume is dispensed by the pump in question and therefore a different volumetric ratio between the two fluid substances dispensed is obtained.

What is claimed is:

1. Dispensing unit for dispensing two fluid substances, comprising:

a pump assembly having a first pump and a second pump, actuable by a common, manually operable operating means to simultaneously dispense the two fluid substances, and a reservoir assembly for holding the two fluid substances, the reservoir assembly comprising two integral reservoirs, which are each provided with an outlet at an outlet side and are each delimited by a movable piston on a side remote from the outlet, wherein each of the pistons moves towards a respective one of the outlets during the dispensing of the fluid substances, characterized in that the reservoir assembly and the pump assembly are separate assemblies which are couplable to one another, in such a manner that in an uncoupled state each reservoir is filled through the outlet of the reservoir, after which the pump assembly and the reservoir assembly are coupled to one another, wherein a diameter or cross section of the first and/or second reservoir is increased in a vicinity of the outlet, in such a manner that the piston is under a reduced prestress in a filling position in the vicinity of the outlet.

2. Dispensing unit according to claim 1, wherein each piston prior to filling of the respective reservoir is located in the filling position close to the outlet.

3. Dispensing unit according to claim 1, wherein a first reservoir is delimited by an inner side of a first substantially cylindrical tube, the reservoir being delimited, on the side remote from the outlet side, by a continuous, substantially disk-like piston.

4. Dispensing unit according to claim 1, wherein a second reservoir is delimited by the outer side of the first cylindrical tube and an inner side of a second substantially cylindrical tube, which surrounds the first cylindrical tube, the reservoir being delimited, on the other side from the outlet side, by a continuous, substantially annular piston.

5. Dispensing unit according to claim 1, wherein the diameter or cross section of the first and/or second reservoir decreases in the direction of the outlet side over at least a section of the length of the reservoir.

6. Dispensing unit according to claim 5, wherein the diameter of the inner side of the first cylindrical tube decreases in the direction of the outlet side.

7. Dispensing unit according to claim 5, wherein the distance between the outer side of the first cylindrical tube and the inner side of the second cylindrical tube decreases in the direction of the outlet side.

8. Dispensing unit according to claim 5, wherein the diameter of the inner side of the second cylindrical tube decreases in the direction of the outlet side, the outer side of the first cylindrical tube being straight.

9. Dispensing unit according to claim 1, wherein the diameter of the inner side of the first cylindrical tube, at the location of the piston position in the vicinity of the outlet, substantially corresponds to the diameter of the substantially disk-like piston.

10. Dispensing unit according to claim 1, wherein the distance between the outer side of the first cylindrical tube and the inner side of the second cylindrical tube, at the location of the piston position in the vicinity of the outlet, substantially corresponds to the width of the ring of the substantially annular piston.

11. Dispensing unit according to claim 1, wherein the reservoir assembly comprises a cover which closes off the reservoirs on the outlet side, the first and second outlets being arranged in the cover.

12. Dispensing unit according to claim 11, wherein the cover is formed integrally with the second cylindrical tube.

13. Dispensing unit according to claim 11, wherein the cover comprises a coupling rim for coupling a pump assembly to it in order to form a dispensing unit.

14. Dispensing unit according to claim 1, wherein the reservoir assembly further comprises a connecting element which connects the first and second cylindrical tubes to one another in the vicinity of those ends of the first and second cylindrical tubes which are remote from the outlet side.

15. Dispensing unit according to claim 14, wherein the connecting element is formed integrally with the first cylindrical tube.

16. Dispensing unit according to claim 11, wherein the cover is connected to the first and/or second cylindrical tube by means of a click-fit connection.

17. Dispensing unit according to claim 14, wherein the connecting element is connected to the first and/or second cylindrical tube by means of a click-fit connection.

* * * * *